US008827762B2

(12) United States Patent
Klenk

(10) Patent No.: US 8,827,762 B2
(45) Date of Patent: Sep. 9, 2014

(54) GRIPPER FOR A TOY AND TOY WITH A GRIPPER

(71) Applicant: Bruder Spielwaren GmbH + Co. KG, Fürth (DE)

(72) Inventor: Rainer Klenk, Laubendorf (DE)

(73) Assignee: Bruder Spielwaren GmbH & Co. KG, Fuerth (DE)

( * ) Notice: Subject to any disclaimer, the term of this patent is extended or adjusted under 35 U.S.C. 154(b) by 21 days.

(21) Appl. No.: 13/749,132

(22) Filed: Jan. 24, 2013

(65) Prior Publication Data

US 2013/0193701 A1 Aug. 1, 2013

(30) Foreign Application Priority Data

Jan. 26, 2012 (DE) ..... 10 2012 201 115

(51) Int. Cl.

| | |
|---|---|
| ***A63H 33/30*** | (2006.01) |
| ***A63H 17/26*** | (2006.01) |
| ***A63H 17/12*** | (2006.01) |
| *A63F 9/30* | (2006.01) |

(52) U.S. Cl.

CPC ..... *A63H 17/26* (2013.01); *A63H 17/12* (2013.01); *A63H 33/3044* (2013.01)

USPC ..... 446/424; 273/447

(58) Field of Classification Search

USPC ..... 446/144, 145, 227, 424, 425; 273/441, 273/447, 448, 459, 460

See application file for complete search history.

(56) References Cited

U.S. PATENT DOCUMENTS

| | | | | |
|---|---|---|---|---|
| 2,326,934 A * | 8/1943 | Erhardt | ..... | 37/184 |
| 3,721,440 A * | 3/1973 | Burns | ..... | 273/446 |
| 5,415,417 A * | 5/1995 | Reis, Jr. | ..... | 273/447 |
| 5,741,188 A * | 4/1998 | Levin et al. | ..... | 472/128 |
| 6,773,016 B2 * | 8/2004 | Ochi | ..... | 273/448 |

FOREIGN PATENT DOCUMENTS

JP 2002120989 A 4/2002

* cited by examiner

*Primary Examiner* — Kien Nguyen

(74) *Attorney, Agent, or Firm* — Browdy and Neimark, PLLC

(57) ABSTRACT

A gripper for a toy has a base body, and two gripping bodies. Each gripping body is connected by a respective gripping body connecting joint to the base body is movable between a release position with an opened gripper and a gripping position with a closed gripper. At least one gripping body is formed as a lever body and has a jaw portion and a lever portion. The associated gripping body connecting joint is arranged between the jaw portion and the lever portion. A control rod is connected to the gripping bodies by a respective control rod connecting joint and, when the gripper is open, is arranged between the gripping bodies in a freely accessible jaw encompassing region. By contact with an item to be gripped, the control rod can be moved between a release position with an opened gripper and a gripping position with a closed gripper.

10 Claims, 5 Drawing Sheets

GRIPPER FOR A TOY AND TOY WITH A GRIPPER

CROSS-REFERENCES TO RELATED APPLICATIONS

This application claims the priority of German Patent Application, Serial No. 10 2012 201 115.3, field Jan. 26, 2012, pursuant to 35 U.S.C. 119(a)-(d), the content of which is incorporated herein by reference in its entirety as if fully set forth herein.

FIELD OF THE INVENTION

The invention relates to a gripper for a toy, in particular for a toy vehicle. Furthermore, the invention relates to a toy, in particular a toy vehicle with a gripper of this type.

BACKGROUND OF THE INVENTION

Grippers of this type are known from public prior use.

A gripper for lifting real loads is known from JP 2002 120 989 A.

SUMMARY OF THE INVENTION

An object of the present invention is to develop a gripper for a toy in such a way that the play experience is enhanced.

This object is achieved according to the invention by a gripper for a toy, with a base body, with a first gripping body and a second gripping body, which are both connected by means of a respective gripping body connecting joint to the base body and can be moved between a release position with an opened gripper and a gripping position with a closed gripper, wherein at least one of the gripping bodies is formed as a lever body and has:

a jaw portion and a lever portion wherein the associated gripping body connecting joint is arranged between the jaw portion and the lever portion with a control rod, which is connected to the two gripping bodies by means of a respective control rod connecting joint and, when the gripper is open, is arranged between the two gripping bodies in a freely accessible jaw encompassing region and can be moved by contact with an item to be gripped between a control rod release position with an opened gripper and a control rod gripping position with a closed gripper.

The item to be gripped itself ensures an automatic movement of the gripper between the release position and the gripping position of the gripping bodies by means of the control rod according to the invention. This automatism makes play situations possible with the gripper, said situations approximating a real model when gripping an item to be gripped. The freely accessible jaw encompassing region is a region adjacent to the gripping bodies in which items to be gripped or grasped are located.

A gripping body prestressing device with a compression spring unit, which is supported on the two gripping bodies and is articulated thereto, allows a prestressing of the gripper into the release position and/or into the gripping position, which further enhances the play experience. The compression spring unit can be supported at least indirectly on a jaw portion and/or on a lever portion of the gripping bodies.

One configuration of the control rod as part of a support transmission mechanism between the compression spring unit and one of the two gripping bodies elegantly combines the functions "movement control" and "compression spring force transmission" in one and the same component, namely in the control rod.

In an arrangement, in which the compression spring unit is arranged in such a way that, in the release position, a force action line of the compression spring unit crosses a connecting line between the two gripping body connecting joints and thus keeps the gripper open, the control rod being arranged in such a way that when the control rod is moved from the control rod release position into the control rod gripping position, a support point of the compression spring unit on at least one of the gripping bodies passes through the connecting line between the two gripping body connecting joints, the prestressing of the compression spring unit is firstly used to keep the gripper open in the release position of the gripping bodies and, after overcoming a dead centre, when the action line of the compression spring unit passes through the connecting line between the two gripping body connecting joints, to close the gripper in the direction of the gripping position of the gripping bodies. This makes the mode of action of the gripper still more closely approximate a real model.

A configuration, in which the compression spring unit is supported between the base body and at least one of the two gripping bodies, allows a compact arrangement of the compression spring unit with the base body.

A configuration, in which the support point of the compression spring unit on one of the gripping bodies coincides with a joint axis of one of the two control rod connecting joints, also leads to the possibility of a compact configuration of the gripper mechanism.

The same applies to a control rod articulation, on the one hand, to a jaw portion of one of the two gripping bodies and, on the other hand, to a lever portion of the other of the two gripping bodies.

A configuration of the control rod with two rod portions, which are spaced apart from one another in the direction of the joint axes of the control rod connecting joints and rigidly connected to one another, improves a stability of a movement guidance of the gripper. The two gripping bodies and/or a lever portion of at least one of the gripping bodies can also accordingly be configured with two component portions, which, in the same way, improves a stability of the movement guidance of the gripper.

An actuating element being formed on a free end of the control rod, together with a counter-holding element, which is attached, for example to the base body, can ensure easy opening of the gripper from the gripping position or from a completely closed closure position. The counter-holding element may simultaneously be a cover of a component of the gripping body prestressing device and, in particular, of the compression spring unit.

An embodiment of the invention will be described in more detail below with the aid of the drawings.

DESCRIPTION OF THE PREFERRED EMBODIMENT

A gripper 1 is an equipment component of a toy, in particular a toy vehicle, for example to the scale 1:16. Regardless, optionally, of individual components, the gripper 1 is manufactured as a whole from plastics material and, in particular, from injection-molded components.

Figure 1:
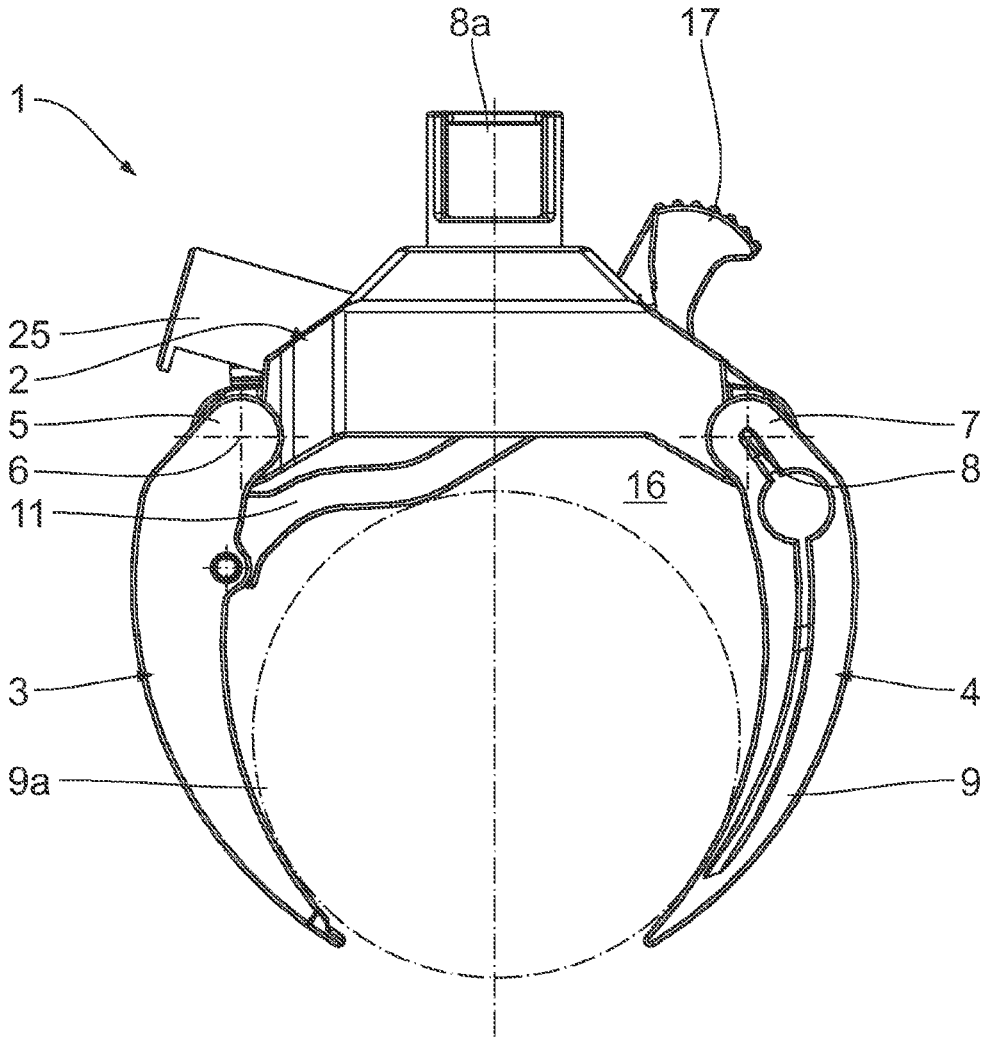
FIG. 1 shows a side view of a gripper for a toy vehicle, shown in a gripping position, in which an object shown at the end face, for example a rod or a miniature toy tree trunk is gripped.
Figure 2:
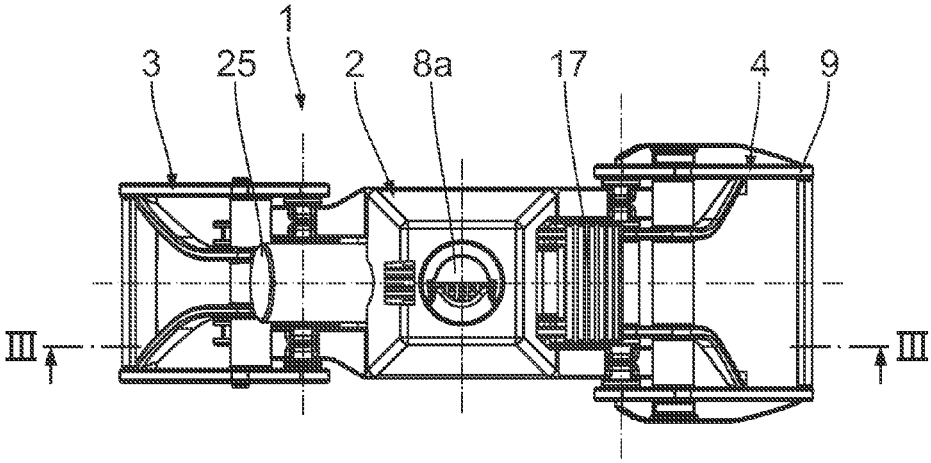
FIG. 2 shows a plan view of the gripper according to FIG. 1 in an open position.

The gripper 1 has a jaw base body 2 and a first gripping body 3, which is shown on the left in FIG. 1, as well as a second gripping body 4, which is shown on the right in FIG. 1. The two gripping bodies 3, 4 are the jaw components of the gripper 1. The first gripping body 3 is connected by a first gripping body connecting joint 5 with a joint axis 6 to the base body 2. The second gripping body 4 is connected by a second base body connecting joint 7 with a joint axis 8 to the base body 2. The gripping bodies 3, 4 can be moved between a release position (compare FIG. 3) with an opened gripper 1, in other words with completely pivoted out jaw components and a gripping position, which is shown in FIG. 1, with a closed gripper 1.

The base body 2 has a connecting portion 8*a*, by means of which the gripper 1 can be removably connected, for example to a crane arm, in particular in an articulated or movable manner.

One of the two gripping bodies 3, 4, namely the right-hand gripping body 4 in FIG. 1, is formed as a lever body and, on the one hand, has a jaw portion 9 and, on the other hand, a lever portion 10. The second gripping body connecting joint 7 is arranged between the jaw portion 9 and the lever portion 10.

In the gripping position, the gripper 1 can grip an external gripping part 9*a*, for example a toy miniature tree trunk, which is shown in an end view in FIG. 1.

The gripper 1 furthermore has a control rod 11. This is connected to the two gripping bodies 3, 4 by means of a respective control rod connecting joint 12, 13 with an associated joint axis 14, 15. The control rod 11 is connected for this purpose, on the one hand, by the control rod connecting joint 12 to the first gripping body 3 and, on the other hand, by the control rod connecting joint 13 to the lever portion 10 of the second gripping body 4.

The connecting joints 5, 7, 12 and 13 have joint axes running parallel to one another.

Figure 3:
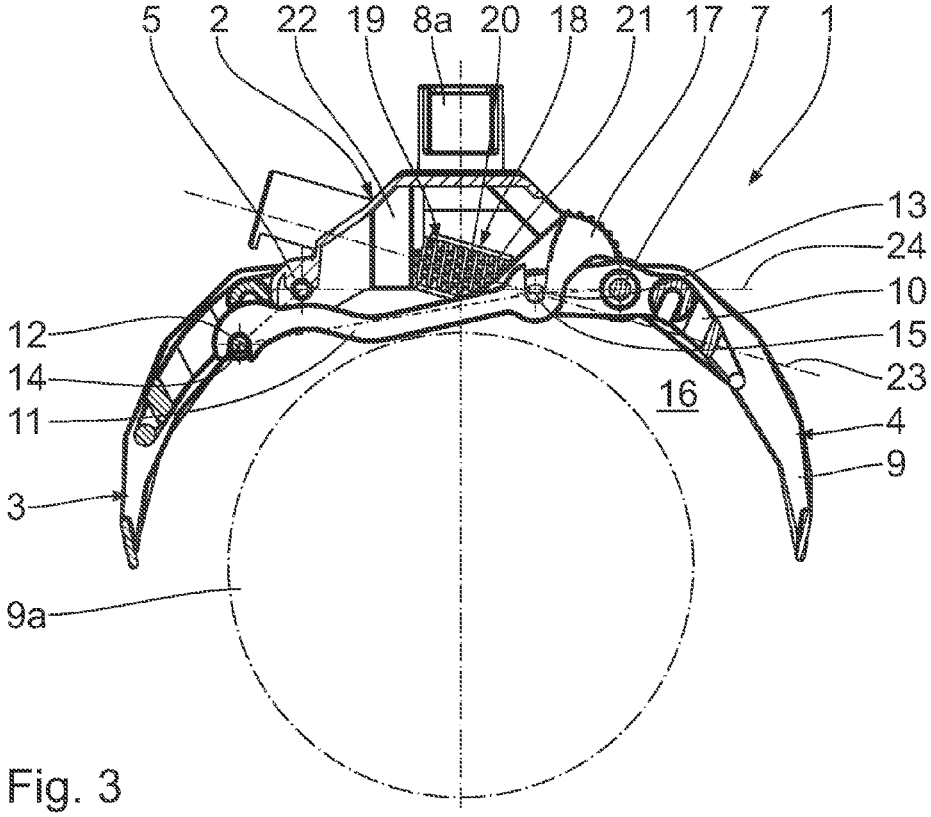
FIG. 3 shows a section along the line III-III in FIG. 2.
Figure 4:
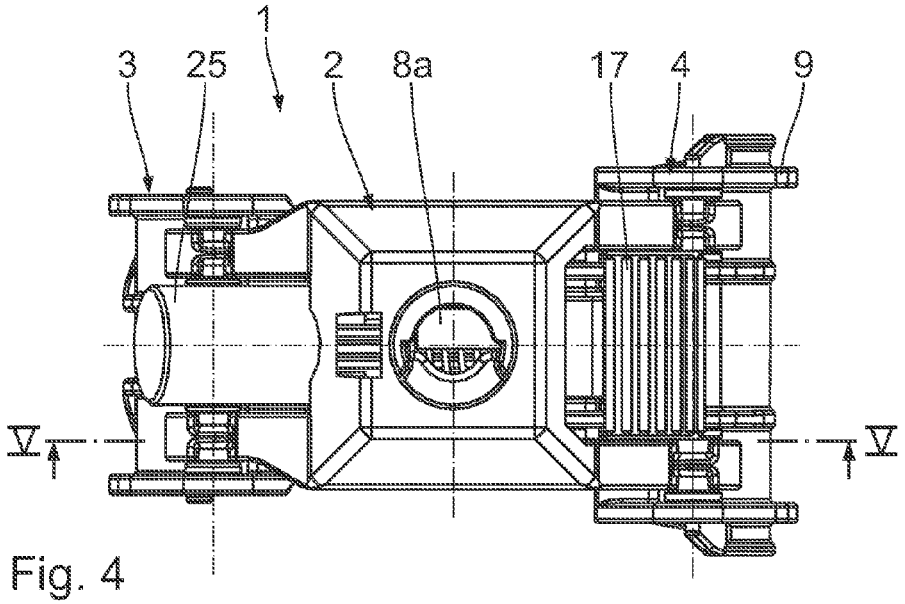
FIG. 4 also shows a plan view of the gripper in the gripping position according to FIG. 1.

When the gripper 1 is open, in other words in the release position according to FIG. 3, the control rod 11 is arranged in a freely accessible jaw encompassing region 16 of the gripper 1.

By contact of the control rod 11 with an item to be gripped, in other words with the gripping part 9*a*, the control rod 11 can be moved between a control rod release position with an opened gripper 1 shown in FIG. 3 and a control rod gripping position according to FIG. 1 with a closed gripper 1.

The control rod 11 is articulated to the jaw portion of the gripping body 3.

The gripping body 3 only has one jaw portion, but no lever portion. In a configuration, not shown, the two gripping bodies can also have a respective jaw portion and a respective lever portion.

The two gripping bodies 3 and 4 and the control rod 11 have two component portions 3*a*, 3*b*, 4*a*, 4*b* and 11*a*, 11*b*, which are spaced apart from one another in the direction of the joint axes of the connecting joints 5, 7, 12 and 13 and rigidly connected to one another. The lever portion 10 of the second gripping body 4 also has two lever lower portions 10*a*, 10*b*, which are spaced apart from one another in the direction of the joint axes of the connecting joints 5, 7, 12 and 13 and rigidly connected to one another. These component portions Xa, Xb improve a stability of a movement guidance of the gripper 1 between the release position according to FIG. 3, the gripping position according to FIG. 1 and a complete closure position according to FIG. 7.

Figure 5:
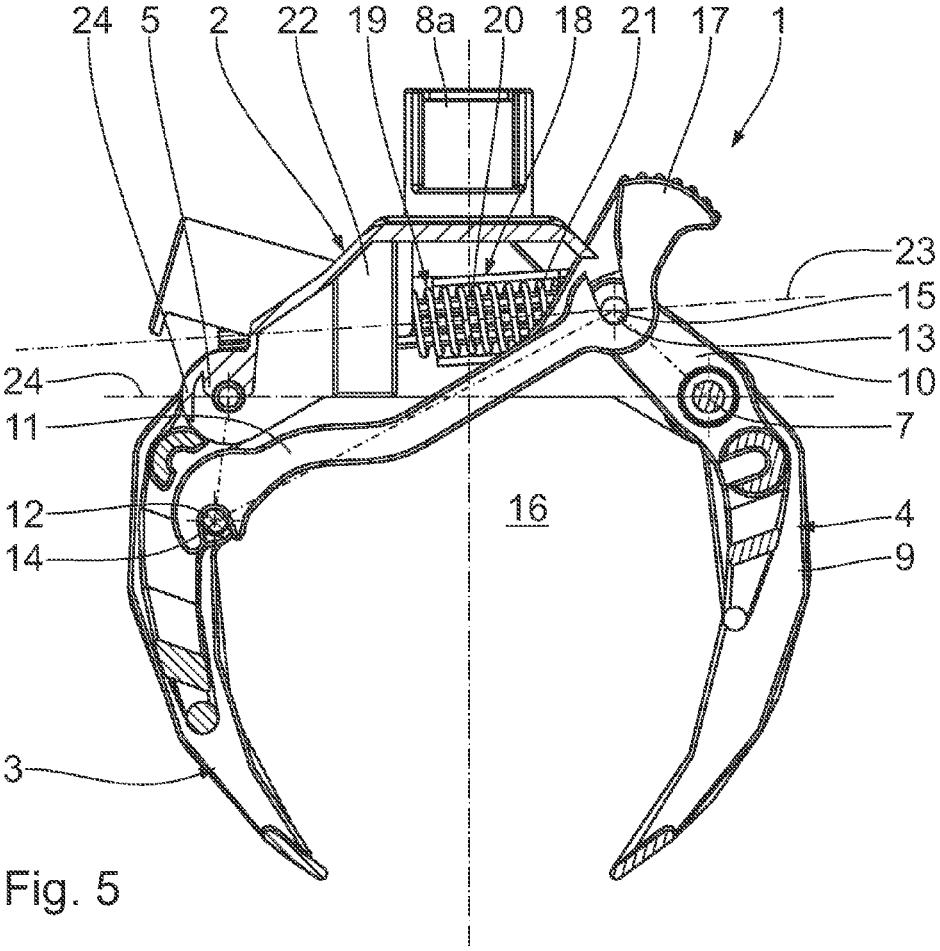
FIG. 5 shows a section along the line V-V in FIG. 4.
Figure 6:
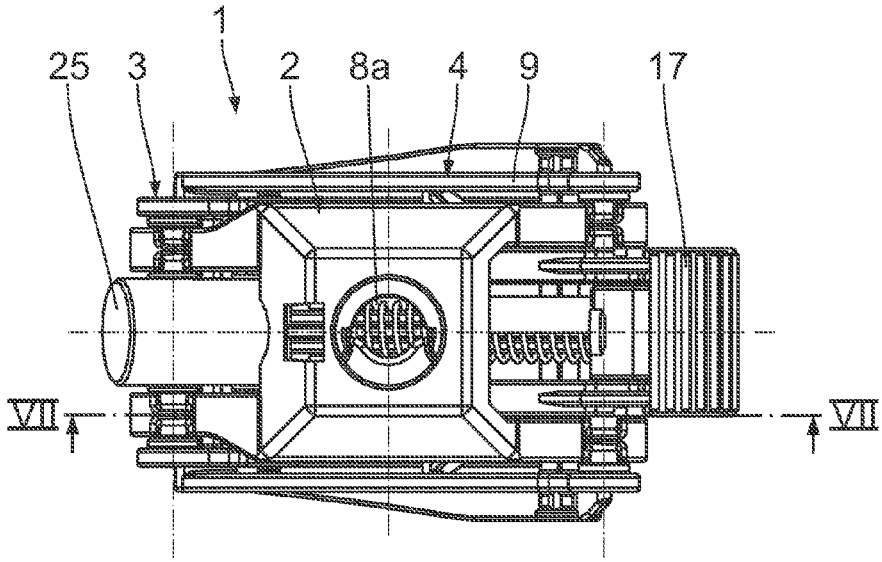
FIG. 6 shows a plan view of the gripper in a maximally closed closure position of gripping bodies of the gripper.
Figure 7:
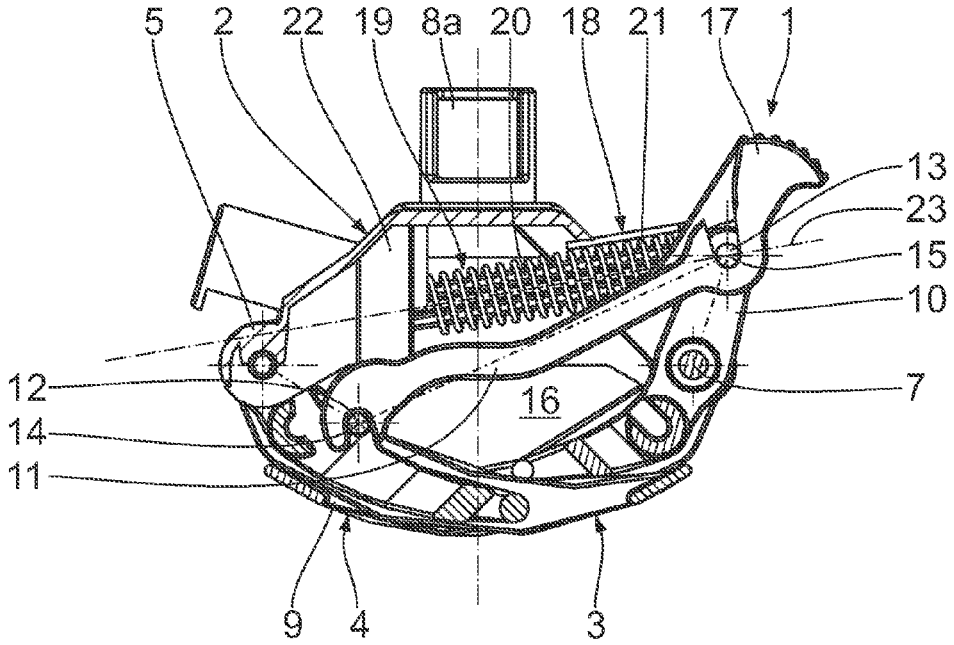
FIG. 7 shows a section along the line VII-VII in FIG. 6.
Figure 8:
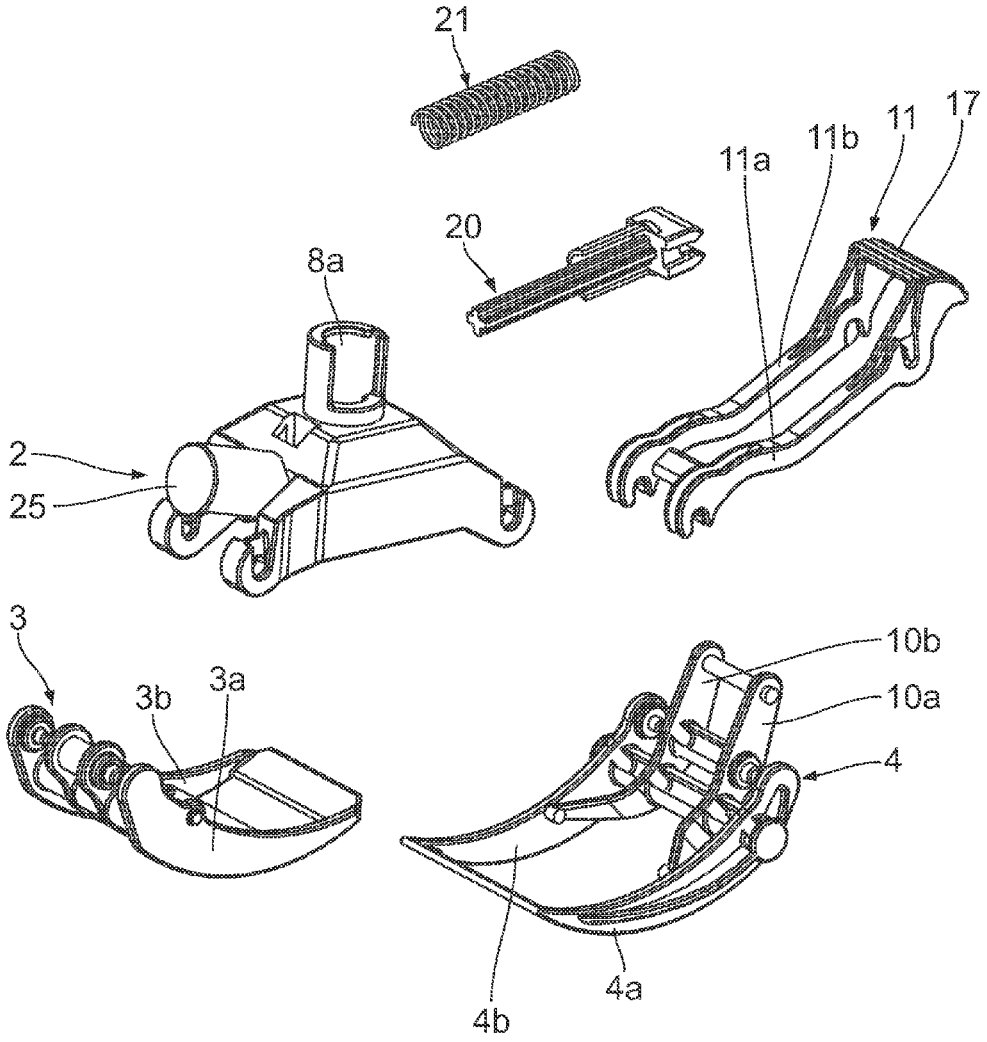
FIG. 8 shows an exploded view of the gripper 1.

Connecting lines between the joint axes of the connecting joints 5, 7, 12 and 13 are shown emphasized in FIGS. 3, 5 and 7 to improve an illustration of kinematic ratios.

Arranged at a free end of the control rod 11 is an actuating element 17. The control rod connecting joint 13 is arranged between the free end 17 and the control rod connecting joint 12.

The gripper 1 has a gripping body prestressing device 18. The latter has a compression spring unit 19 with a spring piston 20 and a compression spring 21. The compression spring unit 19 is supported at least indirectly on the two gripping bodies 3, 4 and is placed thereon. In this case, the control rod 11 is a part of a support transmission mechanism between the compression spring unit 19 and the first gripping body 3.

The compression spring unit 19 is supported on the first gripping body 3 by means of the second control rod connecting joint 13, the control rod 11 and the first control rod connecting joint 12.

By means of the same end of the compression spring unit 19, the latter is supported, also by means of the second control rod connecting joint 13, on the lever portion 10 of the second gripping body 4.

On the base body 2, the compression spring unit 19 is supported on an abutment portion 22. The compression spring 21 is thus prestressed between the second control rod connecting joint 13 and the abutment portion 22.

The compression spring unit 19 is thus supported between the base body 2, on the one hand, and, at least indirectly, the two gripping bodies 3, 4, on the other hand, namely directly on the second gripping body 4 and indirectly by means of the control rod 11 on the first gripping body 3.

A force action line 23 of a prestressing of the compression spring unit 19 in the release position according to FIG. 3 crosses a connecting line 24 between the two gripping body connecting joints 5, 7. In the release position according to FIG. 3, the prestressing force of the gripping body prestressing device 18 therefore holds the gripper 1 open.

The control rod 11 is arranged in such a way that when the control rod 11 is moved from the control rod release position according to FIG. 3 into the control rod gripping position, for example, according to FIG. 5, the support point, which is formed by the second control rod connecting joint 13, of the compression spring unit 19 on the lever portion 10 of the gripping body 4 passes through the connecting line 24 between the two gripping body connecting joints 5, 7. After this passing of the support point 13 through the connecting line 24, the compression spring unit 19, as illustrated by the sequence of FIGS. 5 and 7, acts in the closing direction of the gripper 1. The support point coincides with the joint axis 15 of the second control rod connecting joint 13 on the lever portion 10 of the second gripping body 4.

A sleeve-shaped protective cover 25 for the spring piston 20 of the compression spring unit 19 is formed on the base body 2. This protective cover 25 is simultaneously used as a counter-holding element for the actuating element 17 to open the gripper 1, for example from the complete closure position according to FIG. 7.

What is claimed is:

1. A gripper (1) for a toy, with a base body (2), with a first gripping body (3) and a second gripping body (4), which are both connected by means of a respective gripping body connecting joint (5, 7) to the base body (2) and can be moved between a release position with an opened gripper (1) and a gripping position with a closed gripper (1), wherein at least one of the gripping bodies (3, 4) is formed as a lever body (4) and has:

a jaw portion (9), and a lever portion (10), wherein the associated gripping body connecting joint (7) is arranged between the jaw portion (9) and the lever portion (10), with a control rod (11), which is connected to the two gripping bodies (3, 4) by means of a respective control rod connecting joint (12, 13) and, when the gripper (1) is open, is arranged between the two gripping bodies (3, 4) in a freely accessible jaw encompassing region (16) and can be moved by contact with an item (9*a*) to be gripped between a control rod release position with an opened gripper (1), and a control rod gripping position with a closed gripper (1).

2. A gripper according to claim 1, comprising a gripping body prestressing device (18) with a compression spring unit (19), which is supported on the two gripping bodies (3, 4) and is articulated thereto.

3. A gripper according to claim 2, wherein the control rod (11) is part of a support transmission mechanism between the compression spring unit (19) and one of the two gripping bodies (3, 4).

4. A gripper according to claim 2, wherein the compression spring unit (19) is arranged in such a way that, in the release position, a force action line (23) of the compression spring unit (19) crosses a connecting line (20) between the two gripping body connecting joints (5, 7) and thus keeps the gripper (1) open, the control rod (11) being arranged in such a way that when the control rod (11) is moved from the control rod release position into the control rod gripping position, a support point (13) of the compression spring unit (19) on at least one of the gripping bodies (4) passes through the connecting line (24) between the two gripping body connecting joints (5, 7).

5. A gripper according to claim 4, wherein the support point (13) of the compression spring unit (19) on one of the gripping bodies (4) coincides with a joint axis (15) of one of the two control rod connecting joints (13).

6. A gripper according to claim 2, wherein the compression spring unit (19) is supported between the base body (2) and at least one of the two gripping bodies (3, 4).

7. A gripper according to claim 1, wherein the control rod (11) is articulated, on the one hand, to a jaw portion (3) of one of the two gripping bodies (3, 4) and, on the other hand, to a lever portion (10) of the other of the two gripping bodies (3, 4).

8. A gripper according to claim 1, wherein the control rod (11) has two rod portions (11*a*, 11*b*), which are spaced apart from one another in the direction of the joint axes (13, 15) of the control rod connecting joints (12, 13) and rigidly connected to one another.

9. A gripper according to claim 1, wherein an actuating element (17) is formed on a free end of the control rod (11).

10. A toy with a gripper (1) for a toy, with a base body (2), with a first gripping body (3) and a second gripping body (4), which are both connected by means of a respective gripping body connecting joint (5, 7) to the base body (2) and can be moved between a release position with an opened gripper (1) and a gripping position with a closed gripper (1), wherein at least one of the gripping bodies (3, 4) is formed as a lever body (4) and has:

a jaw portion (9), and a lever portion (10), wherein the associated gripping body connecting joint (7) is arranged between the jaw portion (9) and the lever portion (10), with a control rod (11), which is connected to the two gripping bodies (3, 4) by means of a respective control rod connecting joint (12, 13) and, when the gripper (1) is open, is arranged between the two gripping bodies (3, 4) in a freely accessible jaw encompassing region (16) and can be moved by contact with an item (9*a*) to be gripped between a control rod release position with an opened gripper (1), and a control rod gripping position with a closed gripper (1).

* * * * *